US006113014A

United States Patent [19]

Coldren et al.

[11] Patent Number: 6,113,014

[45] Date of Patent: Sep. 5, 2000

[54] DUAL SOLENOIDS ON A SINGLE CIRCUIT AND FUEL INJECTOR USING SAME

[75] Inventors: Dana R. Coldren, Fairbury; Walter E. Earleson, Morton; Michael A. Caruthers, Peoria, all of Ill.

[73] Assignee: Caterpillar Inc., Peoria, Ill.

[21] Appl. No.: 09/114,357

[22] Filed: Jul. 13, 1998

[51] Int. Cl.[7] ..... B05B 1/30

[52] U.S. Cl. ..... 239/585.1; 239/585.2; 239/585.5; 239/88; 239/90; 239/96; 251/129.15; 335/266; 361/143

[58] Field of Search ..... 239/585.1, 585.2, 239/585.3, 585.4, 585.5, 88, 90, 91, 92, 93, 94, 95, 96; 251/129.15, 129.21; 361/143, 167, 210; 335/262, 266, 268

[56] References Cited

U.S. PATENT DOCUMENTS

| | | | |
|---|---|---|---|
| 3,178,151 | 4/1965 | Caldwell | 335/268 X |
| 3,412,971 | 11/1968 | McDivitt | 251/129.15 |
| 3,481,542 | 12/1969 | Huber . | |
| 4,040,397 | 8/1977 | Leichle | 123/32 |
| 4,295,453 | 10/1981 | Seilly et al. . | |
| 4,681,143 | 7/1987 | Sato et al. | 335/268 X |
| 4,964,571 | 10/1990 | Taue et al. . | |
| 5,141,164 | 8/1992 | Ohno et al. . | |
| 5,494,219 | 2/1996 | Maley et al. . | |
| 5,644,280 | 7/1997 | Wilson et al. . | |

FOREIGN PATENT DOCUMENTS

| | | |
|---|---|---|
| 2 189 940 | 3/1987 | United Kingdom . |
| 2 240 880 | 1/1991 | United Kingdom . |
| WO 97/02425 | 7/1996 | WIPO . |

*Primary Examiner*—Andres Kashnikow
*Assistant Examiner*—Robin O. Evans
*Attorney, Agent, or Firm*—Michael B. McNeil

[57] ABSTRACT

An electronically controlled device, such as a fuel injector, includes a first solenoid and a second solenoid attached to the injector body. An electrical circuit is attached to the injector body, and includes a positive terminal and a negative terminal connected to the first solenoid and the second solenoid. The electrical circuit permits energization of one of the first solenoid and the second solenoid when electrical current flows in either direction between the first terminal and the second terminal. However, the electrical circuit permits energization of the other of the first solenoid and the second solenoid only when current flows in a single direction between the first terminal and the second terminal.

20 Claims, 3 Drawing Sheets

12
13
14
41
42
45
40
15
43
46
44
36
31
39
32
30
26
33
21
23
15
28
37
24
11
29
35
22
20
27
16
10
25
17

DUAL SOLENOIDS ON A SINGLE CIRCUIT AND FUEL INJECTOR USING SAME

TECHNICAL FIELD

The present invention relates generally to electromechanical devices having two or more electrical actuators, and more particularly to the use of two solenoids that are controllable as part of a single electrical circuit in a fuel injector.

BACKGROUND ART

Many electromechanical devices employ two or more separate electrical actuators in their operation. For instance, some fuel injectors use two independently controllable solenoids to control such performance parameters as injection timing and fuel pressurization. While the use of two separately controllable solenoids can improve injector performance, there has been some hesitation in the industry to adopt two or more solenoids in a fuel injector because the benefits do not always outweigh the costs. In addition to financial costs, there are the increased complexity and hardware required to provide each solenoid with a separate electrical circuit. Two separate electrical circuits also tend to undermine robustness and long term reliability in most fuel injector applications. On the other hand, use of a single solenoid to control two separate electrical actuators can lead to a highly sensitive system that requires "glitch" detection in the controller as well as very tight tolerances on the injector assembly.

The present invention is directed to these and other problems associated with the use of two or more electrical actuators in an electromechanical device, such as a fuel injector.

DISCLOSURE OF THE INVENTION

In one aspect, an electronically controlled device includes a first electrical actuator and a second electrical actuator attached to a body. An electrical circuit is attached to the body, and includes a positive terminal and a negative terminal connected to the first electrical actuator and the second electrical actuator. The electrical circuit permits energization of one of the first electrical actuator and second electrical actuator when electrical current flows in either direction between the first terminal and the second terminal. However, the electrical circuit permits energization of the other of the first electrical actuator and the second electrical actuator when current flows in a single direction between the first terminal and the second terminal.

In another aspect, the device is an electronically controlled fuel injector that includes an injector body that defines a fuel pressurization chamber and a nozzle outlet. A first solenoid and a second solenoid are attached to the injector body. An electrical circuit is attached to the injector body, and includes a positive terminal and a negative terminal connected to the first solenoid and the second solenoid. The electrical circuit permits energization of one of the first solenoid and the second solenoid when electrical current flows in either direction between the first terminal and the second terminal. However, the electrical circuit permits energization of the other of the first solenoid and the second solenoid when current flows in a single direction between the first terminal and the second terminal.

BEST MODE FOR CARRYING OUT THE INVENTION

Figure 1:
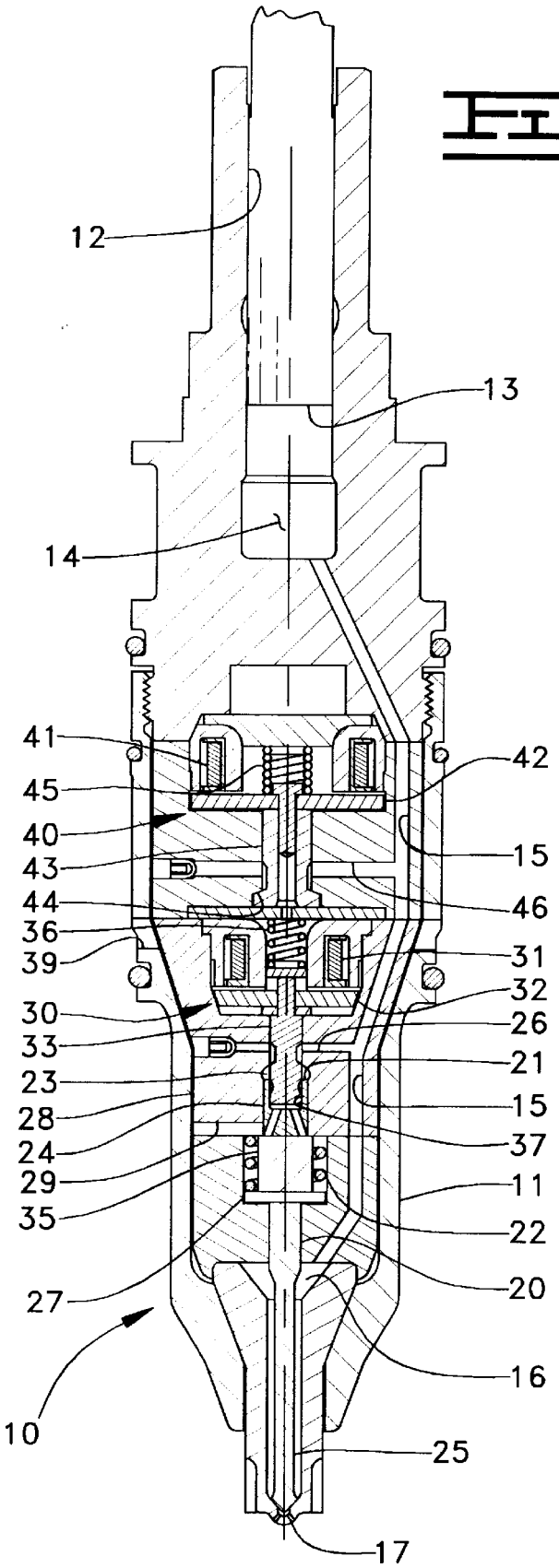
FIG. 1 is a partial front sectioned diagrammatic view of a fuel injector according to one embodiment of the present invention.
Figure 2:
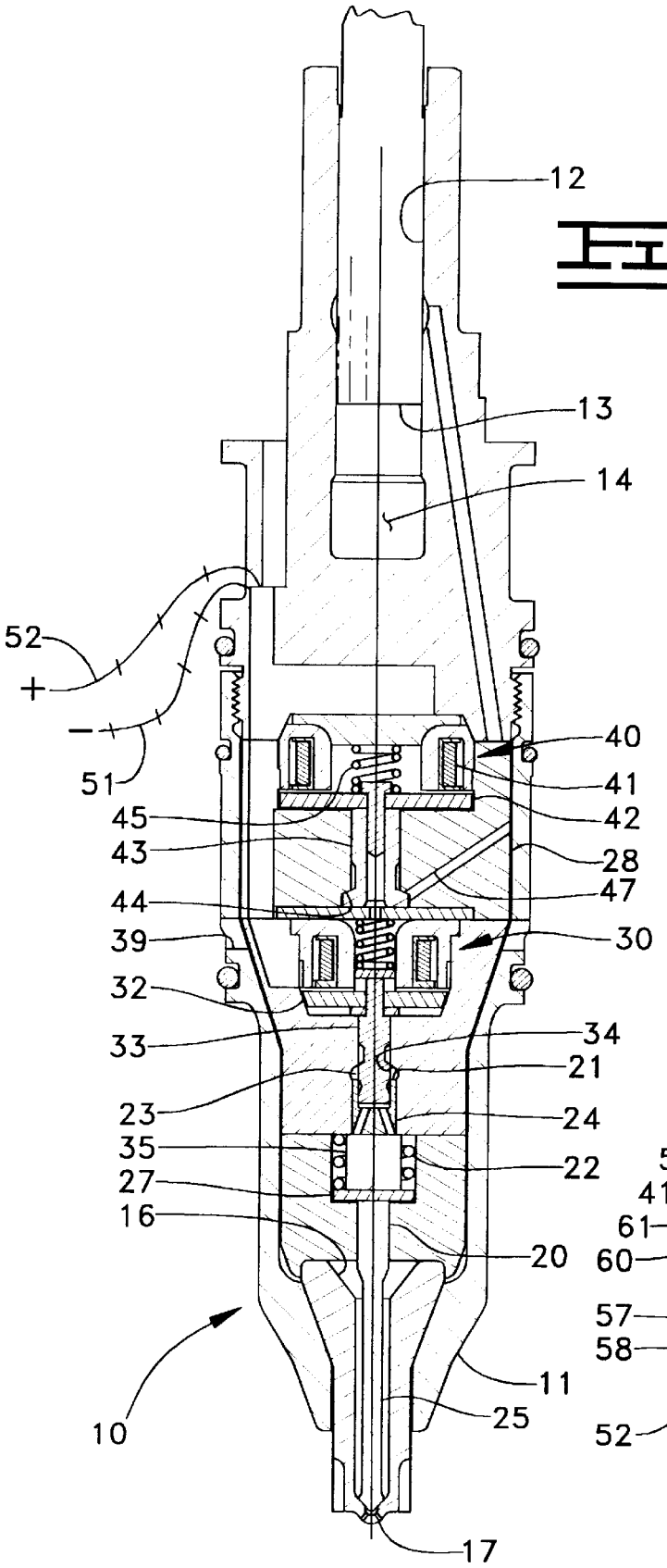
FIG. 2 is a partial side sectioned diagrammatic view of the fuel injector shown in FIG. 1.

Referring now to FIGS. 1 and 2, a fuel injector 10 includes an injector body 11 made up of a plurality of components attached to one another in a manner well known in the art. Injector body 11 defines a plunger bore 12 within which a plunger 13 is driven to reciprocate by some suitable means, such as hydraulic pressure or a cam driven tappet assembly, etc. A portion of plunger bore 12 and plunger 13 define a fuel pressurization chamber 14 that communicates with a nozzle outlet 17 via a high pressure passage 15 and a nozzle chamber 16. A needle valve member 20 is normally biased by a spring 22 to a position that blocks nozzle outlet 17. During an injection event, needle valve member 20 lifts to an open position to open nozzle outlet 17.

When plunger 13 is undergoing its downward pumping stroke, pressure is unable to build in fuel pressurization chamber 14 while a spill valve assembly 40 is in its open position. Spill valve assembly 40 includes a solenoid 41 that has an armature 42 attached to a spill valve member 43. A biasing spring 45 normally biases spill valve member 43 away from high pressure seat 44 to open fluid communication between high pressure spill passage 46 and low pressure spill passage 47. In other words, when spill valve solenoid 41 is de-energized, fuel pressurization chamber 14 is open to an annular low pressure area 28 within injector body 11 via a portion of high pressure passage 15, high pressure spill passage 46 and low pressure spill passage 47. Thus, when spill valve 40 is open, the fuel displaced from fuel pressurization chamber 14 is recirculated for later use, and pressure within the fuel injector is unable to build to the relatively high injection pressures. When spill valve solenoid 41 is energized, armature 42 and spill valve member 43 are lifted to close high pressure seat 44, which causes fuel pressure in fuel pressurization chamber 14, high pressure passage 15 and nozzle chamber 16 to rise rapidly. Thus, in order to raise fuel pressure to initiate an injection event, spill valve solenoid 41 must be energized to close spill valve assembly 40.

In order to control the precise timing at which an injection event will begin, needle valve member 20 includes an annular closing hydraulic surface 21 exposed to fluid pressure in a needle control chamber 23, which may be alternately exposed to low or high pressure. Needle valve member 20 includes a needle portion 25, a spacer portion 27, a pin stop portion 35 and a needle control piston 24. Depending upon the position of a needle control valve member 33, a needle control chamber 23 is either connected to a high pressure passage 26 or a low pressure passage 29. Needle control valve member 33 is a portion of a needle control valve assembly 30 that includes a needle control solenoid 31, which has an armature 32 attached to valve member 33. A biasing spring 36 normally biases armature 32 and needle control valve member 33 downward toward a position that opens high pressure seat 34. When needle control solenoid 31 is de-energized, needle control chamber 23 is in fluid communication with fuel pressurization chamber 14 via a portion of high pressure passage 15 and high pressure passage 26, past high pressure seat 34. When needle control solenoid 31 is energized, needle control valve member 33 lifts to close high pressure seat 34. When this occurs, needle control chamber 23 is fluidly connected to the annular low pressure area 28 via low pressure passage 29, and a small annular clearance area existing between the outer surface of valve member 33 and inner bore 37. Thus, when needle control solenoid 31 is energized, annular closing hydraulic surface 21 is exposed to low fluid pressure, which causes needle valve member 20 to behave as an ordinary spring biased check valve. However, closing hydraulic surface 21 is preferably sized to hold needle valve member 20 in its closed position, even in the presence of high fuel pressures, when solenoid 31 is de-energized.

Figure 3:
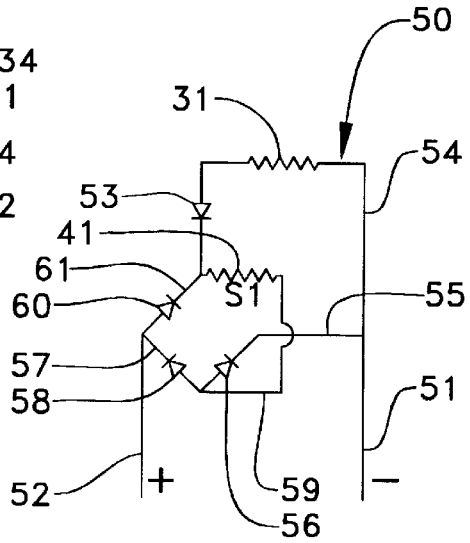
FIG. 3 is an electrical circuit diagram according to one aspect of the present invention.
Figure 4A:
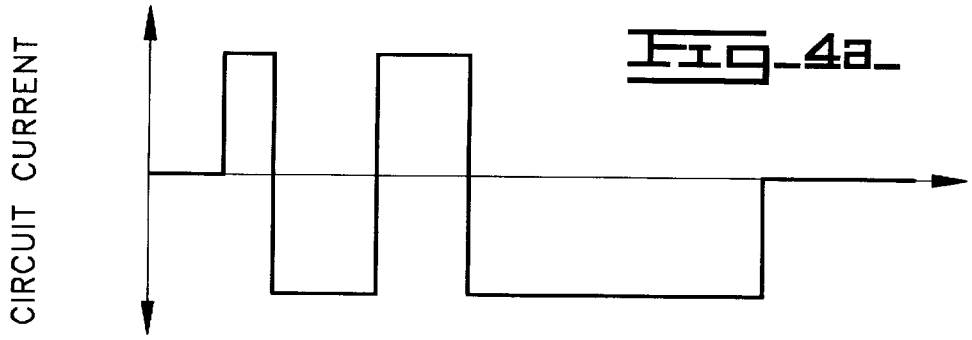
FIGS. 4*a–d* are graphs of circuit current, spill valve position, needle control valve position, and fuel injection mass flow rate, respectively, versus time for a single injection event according to one aspect of the present invention.
Figure 4B:
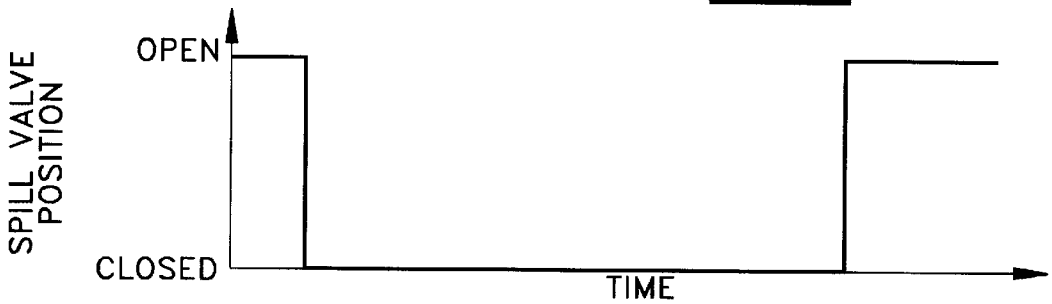
Figure 4C:
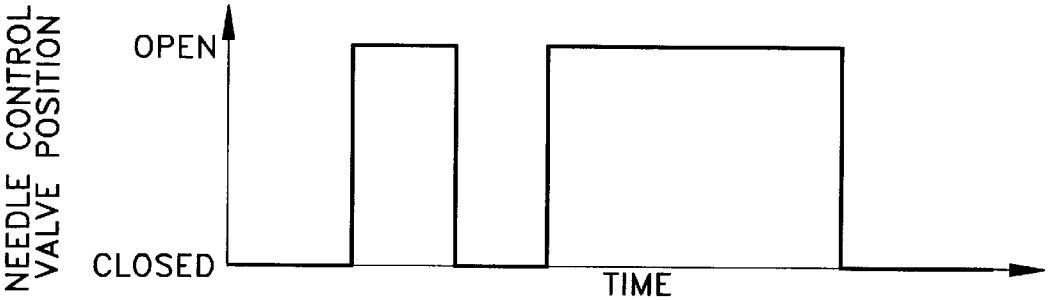
Figure 4D:
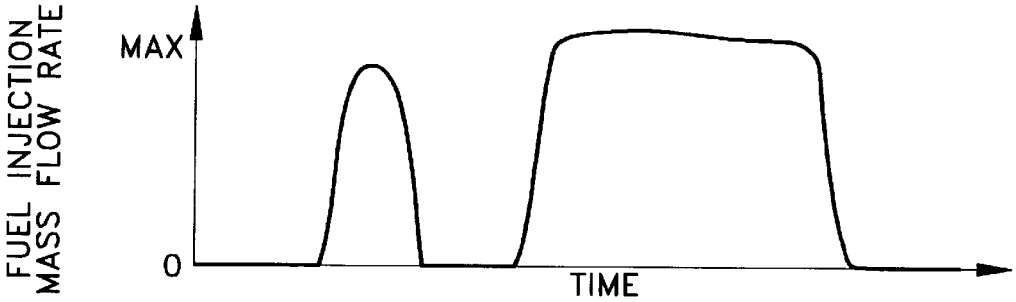

Those skilled in the art will appreciate that spill valve solenoid 41 and needle control valve solenoid 31 must sometimes be energized and de-energized at different times through the injection cycle in order to gain the full benefit produced by independent control of fuel pressurization and injection timing. Thus, in the prior art devices, there has been a tendency to provide two complete electrical circuits that have the ability to independently energize the two solenoids. The present invention, however, includes a single electrical circuit 50 of the type shown in FIG. 3 that includes features that enable the two solenoids 31 and 41 to be energized in a manner suitable for use in a fuel injector of the type shown in FIGS. 1 and 2. Electrical circuit 50 is attached to injector body 11 and includes a positive terminal 52 and a negative terminal 51 that are exposed outside of fuel injector 10 for connection to an engine electrical system in a manner well known in the art.

Electrical circuit 50 includes a plurality of diodes 53, 56, 58, 60 that are attached in a plurality of respective electrical branches 54, 55, 57 and 61 in order to permit injector behavior of the type illustrated in FIGS. 4*a–d*. The positioning of these diodes and branches results in an electrical circuit that permits energization of spill valve solenoid 41 when electrical current flows in either direction between positive terminal 52 and negative terminal 51. It should be noted that current flows through spill valve solenoid 41 in the same direction regardless of the applied voltage polarity. Thus, when a positive voltage is applied, current flows from positive terminal 52 into branch 61 through diode 60, through spill valve solenoid 41 along branch 59, into branch 55 through diode 56, and then to negative terminal 51. In the presence of a positive voltage polarity, diode 53 prevents electric current flow into branch 54 to energize needle control solenoid 31. When a negative voltage is applied to the terminals, electric current flows from negative terminal 51, through needle control solenoid 31 in branch 54, through diode 53, into branch 59 through spill valve solenoid 41, then into branch 57 through diode 58, and then out at positive terminal 52. Thus, the arrangement of the branches and diodes permit energization of spill valve solenoid 41 regardless of the voltage polarity, but permits energization of needle control solenoid 31 only when a negative voltage is applied across terminals 51 and 52. When a negative voltage polarity is applied, the two solenoids are serially arranged. It should also be noted that needle control solenoid 31 decays quickly when a positive voltage is applied; however, both solenoids 31 and 41 tend to decay slowly when an open condition exists.

Industrial Applicability

Referring now in addition to FIGS. 4*a–d,* between injection events no current is applied to electrical circuit 50. When no current is applied, spill valve 40 is biased to its open position, and needle control valve 30 is biased to a position that opens high pressure seat 34. As plunger 13 begins its downward pumping stroke, the fuel is displaced from fuel pressurization chamber 14 into high pressure passage 15, through spill passage 46, past high pressure seat 44, into low pressure spill passage 47 and then to annular low pressure area 28 for recirculation into fuel inlet 39. When it comes time to build fuel pressure for an injection event, a positive voltage is applied across terminals 52 and 51 to energize spill valve solenoid 41. This moves spill valve member 43 upward to close high pressure seat 44 (FIG. 4*a, b*) and allow fuel pressure to build to an injection pressure in fuel pressurization chamber 14, high pressure passage 15 and nozzle chamber 16. However, because needle control solenoid 31 remains unenergized, the building high pressure in passage 15 acts upon annular closing hydraulic surface 21 to hold needle valve member 20 in its downward closed position.

When fuel pressure has reached a desired magnitude, voltage polarity across terminals 51 and 52 is reversed to energize needle control solenoid 31 as shown in FIG. 4*a–d*. When this reversal of voltage polarity occurs, spill valve assembly 40 remains in its closed position, but needle control valve assembly 30 moves from its closed position to its open position to relieve the high pressure in needle control chamber 23. Relatively high fuel pressure in nozzle chamber 16 then lifts needle valve member 20 upward to its open position to commence the spraying of fuel out of nozzle outlet 17.

If a split injection is desired, after an amount of time, the voltage polarity is again reversed to de-energize needle control solenoid 31. When this occurs, needle control valve member 33 moves downward to re-open high pressure seat 34. This connects needle control chamber 23 to the high pressure in high pressure passage 26, which causes needle valve member 20 to quickly move downward to its closed position due to the high hydraulic force acting on annular closing hydraulic surface 21. When it comes time for the main injection event, the voltage polarity is again reversed and the high pressure in needle control chamber 23 is relieved, allowing needle valve member 20 to again move to its upward open position to resume fuel spray out of nozzle outlet 17. The injection event is ended by ceasing all current through electrical circuit 50 so that both solenoids 31 and 41 become de-energized. This causes residual fuel pressure in needle control chamber 23 and the mechanical force from spring 22 to abruptly move needle valve member 20 downward to its closed position to end the injection event.

Although the present invention has been illustrated in the context of a fuel injector 10, the electrical circuitry 50 of the present invention finds potential application in a wide variety of electromechanical devices that include at least two separate electrical actuators that require some independent controllability. Electrical circuit 50 is particularly applicable to fuel injectors of the type shown in FIGS. 1 and 2 because the spill valve assembly 40 needs to be in one position throughout an injection event, but the needle control valve assembly 30 must be controllable within the injection event. This circuitry combined with the presence of biasing springs 22, 36 and 45 ensure that no fuel is injected between injection events and that the valves are reset to a known position before the initiation of each subsequent injection event. Thus, the electrical circuitry 50 of the present invention permits some independent control over two separate electrical actuators. Although the present invention has been illustrated with the use of solenoids, other electrical actuators, such as piezo electric actuators, servo motors, etc., could also be used in an appropriate application with the present invention.

The above description is intended for illustrative purposes only, and is not intended to limit the scope of the present invention in any way. Various modifications and other changes could be made to the illustrated embodiment without departing from the intended spirit and scope of the present invention, which is defined in terms of the claims set forth below.

We claim:

1. An electronically controlled device including:

a body;

a first electrical actuator attached to said body;

a second electrical actuator attached to said body;

an electrical circuit attached to said body, including a first terminal and a second terminal connected to said first electrical actuator and said second electrical actuator;

said electrical circuit permitting energization of one of said first electrical actuator and said second electrical actuator when electrical current flows in either direction between said first terminal and said second terminal; and said electrical circuit permitting energization of the other of said first electrical actuator and said second electrical actuator when current flows in a single direction between said first terminal and said second terminal.

2. The electronically controlled device of claim 1 wherein said body is a valve body defining a first passage and a second passage;

a first valve member closing said first passage when said first electrical actuator is energized; and a second valve member closing said second passage when said second electrical actuator is energized.

3. The electronically controlled device of claim 2 wherein said first electrical actuator includes a first solenoid with a first armature attached to said first valve member; and said second electrical actuator includes a second solenoid with a second armature attached to said second valve member.

4. The electronically controlled device of claim 3 wherein said body is a fuel injector body that defines a fuel pressurization chamber fluidly connected to at least one of said first passage and said second passage.

5. The electronically controlled device of claim 1 wherein said electrical circuit includes a plurality of diodes that permit electric current in only one direction.

6. The electronically controlled device of claim 5 wherein electric current passes through two diodes when flowing from said first terminal to said second terminal.

7. The electronically controlled device of claim 5 wherein electric current flows serially through said first electrical actuator and said second electrical actuator when flowing from said second terminal to said first terminal.

8. The electronically controlled device of claim 5 wherein electronic current flows in a same direction through said one of said first electrical actuator and said second electrical actuator when either positive or negative voltage is applied across said first terminal and said second terminal.

9. An electronically controlled fuel injector including:

an injector body defining a fuel pressurization chamber and a nozzle outlet;

a first solenoid attached to said injector body;

a second solenoid attached to said injector body;

an electrical circuit attached to said injector body, including a positive terminal and a negative terminal connected to said first solenoid and said second solenoid;

said electrical circuit permitting energization of one of said first solenoid and said second solenoid when electrical current flows in either direction between said positive terminal and said negative terminal; and said electrical circuit permitting energization of the other of said first solenoid and said second solenoid when current flows in a single direction between said positive terminal and said negative terminal.

10. The fuel injector of claim 9 wherein said electric circuit includes a plurality of diodes that permit electric current in only one direction.

11. The fuel injector of claim 10 wherein electric current flows serially through said first solenoid and said second solenoid when flowing from one of said negative terminal and said positive terminal to the other of said negative terminal and said positive terminal.

12. The fuel injector of claim 11 wherein electronic current flows in a same direction through said one of said first solenoid and said second solenoid when either positive or negative voltage is applied across said positive terminal and said negative terminal.

13. The fuel injector of claim 12 wherein said injector body further defines a first passage and a second passage;

a first valve member closing said first passage when said first solenoid is energized; and a second valve member closing said second passage when said second solenoid is energized.

14. The fuel injector of claim 13 wherein said second passage connects said fuel pressurization chamber to a low pressure area defined by said injector body.

15. The fuel injector of claim 14 wherein said first passage connects a needle control chamber to a source of high pressure fluid; and a needle valve member positioned in said injector body and moveable between an open position and a closed position which said nozzle outlet is blocked, and having a closing hydraulic surface exposed to fluid pressure in said needle control chamber.

16. The fuel injector of claim 15 wherein said source of high pressure fluid is said fuel pressurization chamber.

17. A fuel injector including an injector body defining a fuel pressurization chamber, a needle control passage, a needle control chamber and a nozzle outlet;

a needle valve member positioned in said injector body and being moveable between an open position in which said nozzle outlet is open, and a closed position in which said nozzle outlet is closed, and said needle valve member having a closing hydraulic surface exposed to fluid pressure in said needle control chamber;

a needle control valve assembly attached to said injector body and including a first solenoid with a first armature attached to a needle control valve member, and said needle control valve member being moveable between an inject position and an off position in which said needle control chamber is connected to a source of high pressure fluid via said needle control passage;

a second solenoid attached to said injector body;

an electrical circuit attached to said injector body, including a positive terminal and a negative terminal connected to said first solenoid and said second solenoid;

said electrical circuit permitting energization of one of said first solenoid and said second solenoid when electrical current flows in either direction between said positive terminal and said negative terminal; and said electrical circuit permitting energization of the other of said first solenoid and said second solenoid when current flows in a single direction between said positive terminal and said negative terminal.

18. The fuel injector of claim 9 wherein said electric circuit includes a plurality of diodes that permit electric current in only one direction;

electric current flows serially through said first solenoid and said second solenoid when flowing from one of said negative terminal and said positive terminal to the other of said negative terminal and said positive terminal; and electronic current flows in a same direction through said one of said first solenoid and said second solenoid when either positive or negative voltage is applied across said positive terminal and said negative terminal.

19. The fuel injector of claim 17 wherein said source of high pressure fluid is said fuel pressurization chamber.

20. The fuel injector of claim 17 wherein said second solenoid is part of a spill valve assembly moveable between a closed position and an open position in which said fuel pressurization chamber is connected to a low pressure area via a spill passage.

* * * * *